US006003172A

United States Patent [19]

Gonzalez et al.

[11] Patent Number: 6,003,172

[45] Date of Patent: Dec. 21, 1999

[54] DEVICE TO FACILITATE THE TRANSFERRING OF PATIENTS FROM ONE RESTING BED TO ANOTHER

[76] Inventors: Mayela Gonzalez; Carlos M. Gonzalez, both of 3924 Tedrich Blvd., Fairfax, Va. 22031

[21] Appl. No.: 08/937,405

[22] Filed: Sep. 25, 1997

[51] Int. Cl.[6] ..... A61G 7/10

[52] U.S. Cl. ..... 5/81.1 HS; 5/487

[58] Field of Search ..... 5/81.1 HS, 81.17, 5/81.1 R, 89.1, 487, 482, 926

[56] References Cited

U.S. PATENT DOCUMENTS 3,284,816 11/1966 Laubsch ..... 5/81.1 T
3,769,642 11/1973 Warman ..... 5/81.1 T
3,829,914 8/1974 Treat ..... 5/81.1 T
3,849,813 11/1974 Neilson ..... 5/81.1 T
4,700,417 10/1987 McGovern ..... 5/81.1 T
5,148,558 9/1992 Dunn ..... 5/81.1 T

*Primary Examiner*—Michael F. Trettel

[57] ABSTRACT

The present invention is generally related to a device for facilitating the transferring of patients from one resting bed or stretcher to another. The device is a transferring sheet that is placed about one half on top of the source's bed and the other half on top of the target bed. The patient is transferred from one bed to the other by sliding on top of the transfer sheet.

3 Claims, 2 Drawing Sheets

DEVICE TO FACILITATE THE TRANSFERRING OF PATIENTS FROM ONE RESTING BED TO ANOTHER

BACKGROUND OF THE INVENTION

At the present time nurses, paramedics and doctors have two options to transfer a patient from one bed or stretcher to another bed or stretcher. The preferred option is the use of a hard board. In order to do this transfer they roll the patient onto the hard board, then pull the hard board onto the destination bed, and finally pull the hard board from under the patient. When a hard board is not available, the transfer of the patient is done by physically lifting the patient in a bed sheet from one bed to the other. This process becomes a major problem when the patient is big and heavy, requiring the use of many people to do the transfers, as well as exposing the transferring team to back injuries.

When patients are in pain, they do not wish to be moved, even a simple roll onto a hard board may be painful. When moving is absolutely necessary the patient wants for the process to be as smooth and as pain free as possible.

One of the problems with using hard boards is that hospitals usually do not have them easily available. Hard boards are costly, inflexible, and difficult to store efficiently.

Another problem with using hard boards is that because they are not disposable and require to be decontaminated every time they are used on a patient, they become a potential high risk hygiene control.

To overcome these shortcomings of existing options, the present invention is developed to produce an effective means to facilitate the transfer of patients from one bed (or stretcher) to another bed (or stretcher). The invention described here will provide simple access of an easy to use, flexible, disposable and inexpensive transfer device.

The flexibility of our transferring device will ensure a smooth and minimal pain free transfer. This is accomplish because the transfer device is easily contoured to the patient's body with a minimum of effort and movement on the patient's part.

SUMMARY OF THE INVENTION

The present invention is a device to facilitate the transferring of patients from one resting bed or stretcher to another bed or stretcher. The device is composed of only one part, The transfer sheet is placed about one half on top of the source bed and the other half on top of the target bed. The patient is transferred from one bed to the other by sliding on top of the transferring sheet.

By using the transfer sheet the patient is moved on one single motion, making the process less stressful for the patient and the transferring team.

The transferring sheets are made of a soft and flexible material. Plastic Polyethylene could be an example of this material. Because the transfer sheet will never hold the patient's weight by itself, the sheet does not have to be very thick. Thus, they can be efficiently stored in boxes for easy access, and can be safely disposed off.

BRIEF DESCRIPTION OF THE DRAWINGS

Other objects and advantaged of the invention will become more apparent from the specification taken in conjunction with the accompanying drawings, in which.

DETAILED DESCRIPTION OF THE INVENTION

A device to facilitate the transferring of patients from one resting bed or stretcher to another bed or stretcher. The device is composed of only one part, the transfer sheet (numbered 3), depicted in FIG. 1 and 2.

Figure 1:
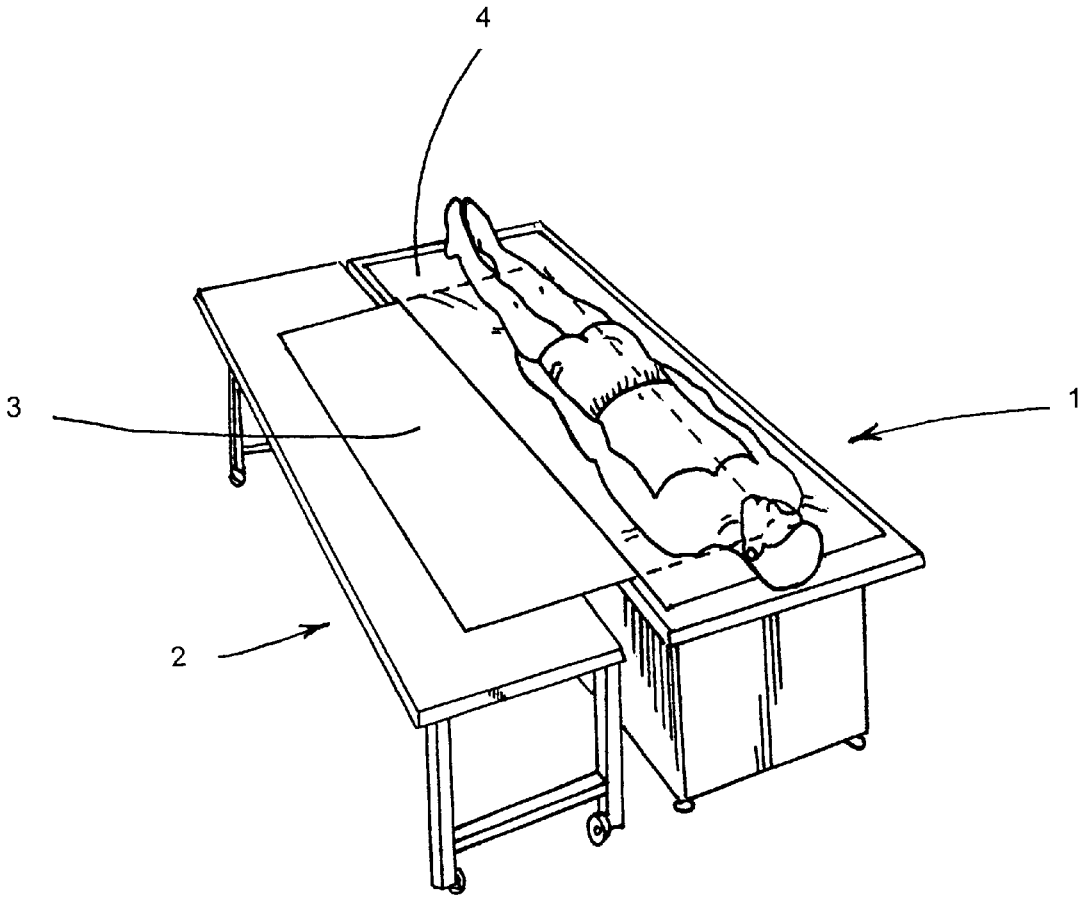
FIG. 1 is a perspective view of a patient that is going to be transferred from one bed to another, and the location of the transfer sheet.
Figure 2:
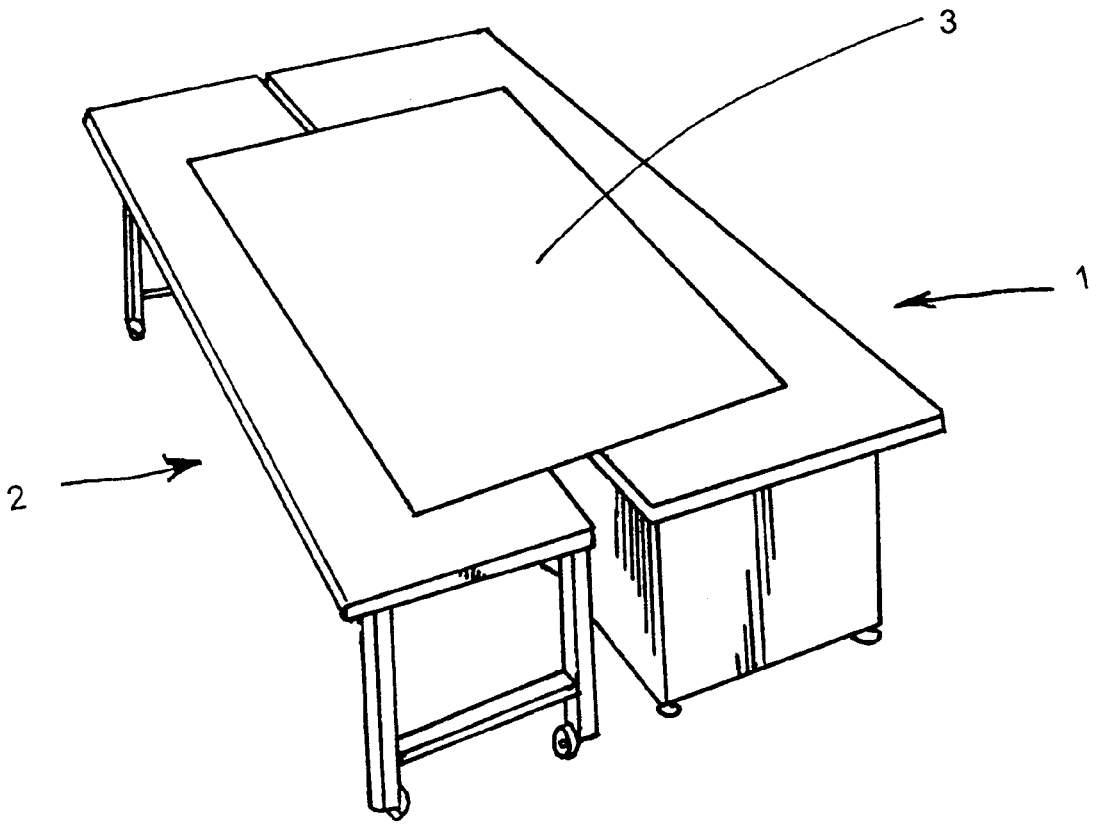
FIG. 2 is a perspective view of a transfer sheet.

To transfer a patient from one resting bed (numbered 1) depicted in FIG. 1 and 2 to another bed (numbered 2) depicted in FIG. 1 and 2, the transferring team places the transfer sheet (numbered 3) depicted in FIG. 1 and 2 under the bed sheet numbered 4 depicted in FIG. 1 on which the patient lies. If no bed sheet 4 is available, one must be placed on top of the transferring sheet 3. The placing of the transferring sheet 3 is done by placing under the patient's body enough transferring sheet 3 to cover about one half to two thirds of the patient's body-width, and cover at least from the shoulders to mid thigh length-wise. The patient's head is either lifted by the transferring team or by the patients themselves. Because the transferring sheet 3 is flexible, the placing of the transferring sheet 3 is done by tucking in the transferring sheet 3 under the patient, following the patient's body contour, with a minimum rolling motion of the patient, the transferring team has used about one half of the transferring sheet 3, the other part of the transferring sheet 3 will be used on the destination bed 2. Once the transferring sheet 3 is properly placed under the patient's resting bed 1, the destination bed 2 is placed adjacent and in a parallel to the source bed 1. The remaining transferring sheet 3 is placed on top of the empty destination bed 2 as depicted in FIG. 1. The transferring team then proceeds to pull the patient from the source bed 1 to the destination bed 2 by sliding on top of the transfer sheet 3. Once the patient is on the destination bed 2, the transferring sheet 3 is then pulled from under the patient and disposed off.

The disclosure of the invention described herein-above represents the preferred embodiment of the invention; however, variations thereof, in the form, construction, and arrangement of the component thereof and the modified application of the invention are possible without departing from the spirit and scope of the appended claim.

We claim:

1. A method for moving a patient from one bed to another by one or more medical attendants with minimal pain and discomfort for the patient, and minimal effort by the attendants, said method comprising:

a) selecting a disposable transfer sheet, b) placing a portion of said transfer sheet on a bed surface; said transfer sheet with a patient engaging surface facing up and the opposing side of said transfer sheet in contact with the bed surface and both surfaces being transversely under a selected portion of the patient's body; said transfer sheet will at least partially conform with the contour of a portion of the patient's body and provide a sufficient sliding surface for moving the patient, c) placing the portion of said transfer sheet that is not under said patient on top and along the target bed covering enough area of said target bed to provide a sufficient sliding surface for moving said patient, d) moving the patient from the resting bed to the target bed by sliding him over the patient engaging surface of the transfer sheet; said transfer sheet remaining substantially stationary during said patient movement.

2. The method of claim 1 where said patient is resting on top of a fabric sheet; said fabric sheet having a width greater than the width of said patient and of a length to underlie at least the patient's torso from approximately the shoulders to the buttocks; pulling laterally on one side of said fabric sheet and sliding said fabric sheet over said transfer sheet to said target bed; thereby moving the patient who is laying on said fabric sheet from the resting bed to said target bed.

3. The method of claim 1 where the said transfer sheet has a low frictional drag on both sides of said transfer sheet, thereby placing of said transfer sheet can be done on either side.

* * * * *